United States Patent [19]

Ketchum et al.

[11] Patent Number: 4,910,781

[45] Date of Patent: Mar. 20, 1990

[54] CODE EXCITED LINEAR PREDICTIVE VOCODER USING VIRTUAL SEARCHING

[75] Inventors: Richard H. Ketchum, Wheaton; Willem B. Kleijn, Batavia; Daniel J. Krasinski, Glendale Heights, all of Ill.

[73] Assignee: AT&T Bell Laboratories, Murray Hill, N.J.

[21] Appl. No.: 67,650

[22] Filed: Jun. 26, 1987

[51] Int. Cl.[4] ..... G10L 7/02

[52] U.S. Cl. ..... 381/36

[58] Field of Search ..... 381/36-41, 381/29-32, 51; 364/513.5; 375/122

[56] References Cited

U.S. PATENT DOCUMENTS 4,720,861 1/1988 Bertrand ..... 381/36

OTHER PUBLICATIONS

Adoul et al., "Fast Celp Coding Based on Algebraic Codes", IEEE ICASSP, 81, pp. 1957-1960.

Crossman et al., "Multipulse Excited Channel Vocoder", IEEE ICASSP, 87, pp. 1926-1930.

Troncoso et al., "Efficient Procedures for Finding the Optimum Innovation in Stochastic coders", IEEE ICASSP, 86, pp. 2375-2378.

Schroeder et al, "Code-Excited Linear Prediction (HELP): High Quality Speech at Very Low Bit Rates", IEEE ICASSP, 85, pp. 937-940.

Singhal, S. and B. S. Atal, "Improving Performance of Multi-Pulse LPC Coders at Low Bit Rates", Proc. Int. Conf. Acoust., Speech and Sign. Process., San Diego, 1.3.1-1.3.4, 1984.

Atal, B. S. and M. R. Schroeder, "Stochastic Coding of Speech Signals at Very Low Bit Rates", Proc. of ICC, Amsterdam, 1610-1613, 1984.

Trancoso, I. M. and B. S. Atal, "Efficient Procedures for Finding the Optimum Innovation in Stochastic Coders", Proc. Int. Conf. Acoust., Speech and Sign. Process., Tokyo, 2379-2382, 1986.

Atal, B. S., "High-Quality Speech at Low Bit Rates: Multi-Pulse and Stochastically Excited Linear Predictive Coders", Proc. Int. Conf. Acoust., Speech and Sign. Process., Tokyo, 1681-1684, 1986.

Chen, J. H. and Gersho, A., "Real-Time Vector APC Speech Coding at 4800 bps with Adaptive Postfiltering", Proc. Int. Conf. Acoust., Speech and Sign. Process., Dallas, 2185-2188, 1987.

*Primary Examiner*—David L. Clark
*Assistant Examiner*—John A. Merecki
*Attorney, Agent, or Firm*—John C. Moran

[57] ABSTRACT

Apparatus for encoding speech using a code excited linear predictive (CELP) encoder using a virtual searching technique during speech transitions such as from unvoiced to voiced regions of speech. The encoder compares candidate excitation vectors stored in a codebook with a target excitation vector representing a frame of speech to determine the candidate vector that best matches the target vector by repeating a first portion of each candidate vector into a second portion of each candidate vector. For increased performance, a stochastically excited linear predictive (SELP) encoder is used in series with the adaptive CELP encoder. The SELP encoder is responsive to the difference between the target vector and the best matched candidate vector to search its own overlapping codebook in a recursive manner to determine a candidate vector that provides the best match. Both of the best matched candidate vectors are used in speech synthesis.

18 Claims, 5 Drawing Sheets

$$r_1^T H^T H r_1 = \begin{bmatrix} X_0 & X_1 & X_2 & X_3 & X_4 \end{bmatrix} \begin{bmatrix} A_0 & A_1 & A_2 & A_3 & A_4 \\ A_1 & A_0 & A_1 & A_2 & A_3 \\ A_2 & A_1 & A_0 & A_1 & A_2 \\ A_3 & A_2 & A_1 & A_0 & A_1 \\ A_4 & A_3 & A_2 & A_1 & A_0 \end{bmatrix} \begin{bmatrix} X_0 \\ X_1 \\ X_2 \\ X_3 \\ X_4 \end{bmatrix}$$

FIG. 3

$$r_2^T H^T H r_2 = \begin{bmatrix} X_1 & X_2 & X_3 & X_4 & X_5 \end{bmatrix} \begin{bmatrix} A_0 & A_1 & A_2 & A_3 & A_4 \\ A_1 & A_0 & A_1 & A_2 & A_3 \\ A_2 & A_1 & A_0 & A_1 & A_2 \\ A_3 & A_2 & A_1 & A_0 & A_1 \\ A_4 & A_3 & A_2 & A_1 & A_0 \end{bmatrix} \begin{bmatrix} X_1 \\ X_2 \\ X_3 \\ X_4 \\ X_5 \end{bmatrix}$$

FIG. 4

$$r_1^T H^T H r_1 = \begin{bmatrix} \overset{501}{X_0} & X_1 & X_2 & X_3 & X_4 \end{bmatrix} \begin{bmatrix} A_0 & A_1 & A_2 & A_3 & A_4 \\ A_1 & A_0 & A_1 & A_2 & A_3 \\ A_2 & A_1 & A_0 & A_1 & A_2 \\ A_3 & A_2 & A_1 & A_0 & A_1 \\ \underset{504}{A_4} & A_3 & A_2 & A_1 & A_0 \end{bmatrix} \begin{bmatrix} \overset{503}{X_0} \\ X_1 \\ X_2 \\ X_3 \\ X_4 \end{bmatrix}$$

502

FIG. 5

$$r_2^T H^T H r_2 = \begin{bmatrix} X_1 & X_2 & X_3 & X_4 & \overset{601}{X_5} \end{bmatrix} \begin{bmatrix} A_0 & A_1 & A_2 & A_3 & \overset{604}{A_4} \\ A_1 & A_0 & A_1 & A_2 & A_3 \\ A_2 & A_1 & A_0 & A_1 & A_2 \\ A_3 & A_2 & A_1 & A_0 & A_1 \\ A_4 & A_3 & A_2 & A_1 & A_0 \end{bmatrix} \begin{bmatrix} X_1 \\ X_2 \\ X_3 \\ X_4 \\ \underset{603}{X_5} \end{bmatrix}$$

602

FIG. 6

CODE EXCITED LINEAR PREDICTIVE VOCODER USING VIRTUAL SEARCHING

CROSS-REFERENCE TO RELATED APPLICATION

The following application was filed concurrently with this application and is assigned to the same assignees as this application:

R. H. Ketchum, et al, "Improved Code Excited Linear Predictive Vocoder", Ser. No. 067,649.

MICROFICHE APPENDIX

Included in this application is Microfiche Appendix A. The total number of microfiche is 1 sheet and the total number of frames is 37.

TECHNICAL FIELD

This invention relates to low bit rate coding and decoding of speech and in particular to an improved code excited linear predictive vocoder that provides high performance.

BACKGROUND AND PROBLEM

Code excited linear predictive coding (CELP) is a well-known technique. This coding technique synthesizes speech by utilizing encoded excitation information to excite a linear predictive coding (LPC) filter. This excitation is found by searching through a table of excitation vectors on a frame-by-frame basis. The table, also referred to as codebook, is made up of vectors whose components are consecutive excitation sample. Each vector contains the same number of excitation samples as there are speech samples in a frame. The codebook is constructed as an overlapping table in which eht excitation vectors are defined by shifting a window along a linear array of excitation samples. The analysis is performed by first doing an LPC analysis on a speech frame to obtain a LPC filter that is then excited by the various candidate vectors in the codebook. The best candidate vector is chosen on how well its corresponding synthesis output matches a frame of speech. After the best match has been found, information specifying the best codebook entry and the filter are transmitted to the synthesizer. The synthesizer has a similar codebook and accesses the appropriate entry in that codebook and uses it to excite an identical LPC filter. In addition, it utilizes the best candidate excitation vector to update the codebook so that the codebook adapts to the speech.

The problem with this technique is that the codebook adapts very slowly during speech transitions such as from unvoiced regions to voiced regions of speech. Voiced regions of speech are characterized in that a fundamental frequency is present in the speech. This problem is particularly noticeable for women since the fundamental frequencies that can be generated by women are higher than those for men.

SUMMARY OF THE INVENTION

The following problem is solved and a technical advance is achieved by a vocoder that utilizes virtual searching of the codebook containing the candidate excitation vectors to improve response during speech transitions such as from unvoiced to voiced regions of speech. A method in accordance with this invention comprises the steps of: grouping speech into frames, comparing candidate sets of excitation information stored in a table with the samples of the present frame to determine the candidate set that best matches the present speech by repeating a first portion of each group of the candidate sets in a second portion of each of the group of candidate sets of information, determining the location of the best matched candidate set in the table, and communicating that location for reproduction of the speech by a decoder.

Advantageously, the step of comparing comprises the steps of: storing candidate sets of excitation information as a linear array of samples in the table, shifting a window equal to the number of samples in each candidate set through the array to form candidate sets of excitation information thereby creating candidate sets of the group towards the end of the linear array for which there are not enough samples to fill the second portion of the group's candidate sets, and repeating the first portion of each candidate set of the group in the second portion of each of the group to complete each of the group. Also, the other candidate sets obtained by shifting the window through the linear array other than those that are part of the group are filled entirely with sequential samples from the table.

Advantageously, the comparing step further comprises the steps of: forming a target set of excitation information in response to the present frame of speech, calculating a temporary set of excitation information from the target set and the best matched set of excitation information, searching another table for other candidate sets with the temporary set of excitation information to determine the candidate set from the other table that best matches the temporary excitation set, determining the other location of the best matched candidate set in the other table, and the communicating step further communicates the other location for speech reproduction.

In addition, the comparing step further comprises the steps of: determining filter coefficients in response to the present speech frame, calculating finite impulse response filter information from the set of filter coefficients, recursively calculating an error value for each of the candidate sets stored in the table in response to the finite impulse response filter information and the target set of excitation information, and selecting the best candidate set on the basis that it has the smallest error value. Also, the communicating step further communicates the filter coefficients for speech reproduction.

Advantageously, an apparatus in accordance with this invention has a searcher circuit that searches through a plurality of candidate sets of excitation information in a table to determine the candidate set that best matches samples for a present frame of speech by repeating a first portion of each candidate set of a group of candidate sets into a second portion of each candidate set of the group. Further, the apparatus has a encoder for communicating information identifying the best matched candidate set's location in the table for reproduction of the speech by a decoder.

BRIEF DESCRIPTION OF THE DRAWING

FIGS. 3 through 6 illustrate, in graphic form, the vector and matrix operation used in selecting the best candidate vector;

DETAILED DESCRIPTION

Figure 1:
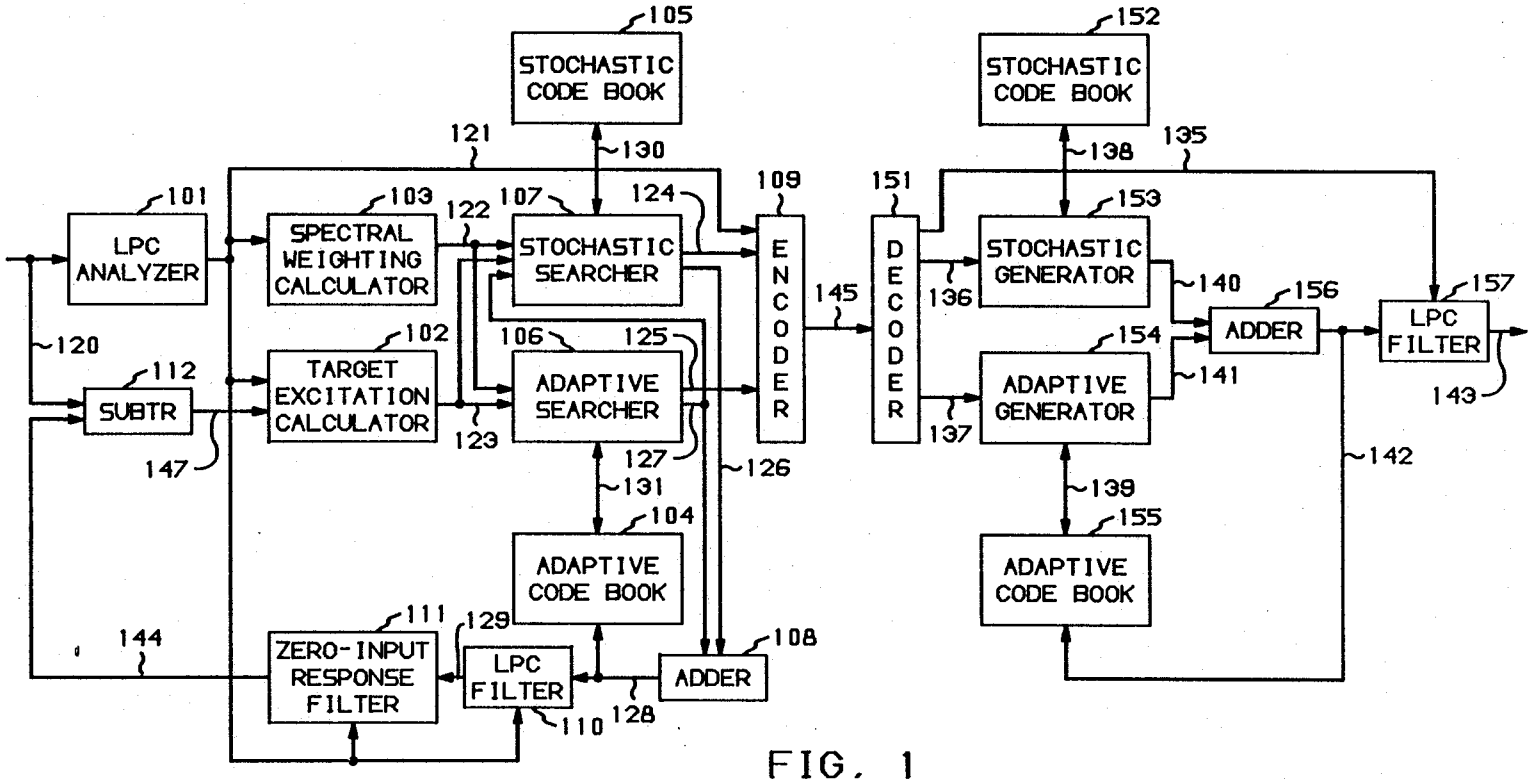
FIG. 1 illustrates, in block diagram form, analyzer and synthesizer sections of a vocoder which is the subject of this invention.

FIG. 1 illustrates, in block diagram form, a vocoder which is the subject of this invention. Elements 101 through 112 represent the analyzer portion of the vocoder; whereas, elements 151 through 157 represent the synthesizer portion of the vocoder. The analyzer portion of FIG. 1 is responsive to incoming speech received on path 120 to digitally sample the analog speech into digital samples and to group those digital samples into frames using well-known techniques. For each frame, the analyzer portion calculates the LPC coefficients representing the formant characteristics of the vocal tract and searches for entries from both the stochastic codebook 105 and adaptive codebook 104 that best approximate the speech for that frame along with scaling factors. The latter entries and scaling information define excitation information as determined by the analyzer portion. This excitation and coefficient information is then transmitted by encoder 109 via path 145 to the synthesizer portion of the vocoder illustrated in FIG. 1. Stochastic generator 153 and adaptive generator 154 are responsive to the codebook entries and scaling factors to reproduce the excitation information calculated in the analyzer portion of the vocoder and to utilize this excitation information to excite the LPC filter that is determined by the LPC coefficients received from the analyzer portion to reproduce the speech.

Consider now in greater detail the functions of the analyzer portion of FIG. 1. LPC analyzer 101 is responsive to the incoming speech to determine LPC coefficients using well-known techniques. These LPC coefficients are transmitted to target excitation calculator 102, spectral weighting calculator 103, encoder 109, LPC filter 110, and zero-input response filter 111. Encoder 109 is responsive to the LPC coefficients to transmit the latter coefficients via path 145 to decoder 151. Spectral weighting calculator 103 is responsive to the coefficients to calculate spectral weighting information in the form of a matrix that emphasizes those portions of speech that are known to have important speech content. This spectral weighting information is based on a finite impulse response LPC filter. The utilization of a finite impulse response filter will be shown to greatly reduce the number of calculations necessary for performing the computations performed in searchers 106 and 107. This spectral weighting information is utilized by the searchers in order to determine the best candidate for the excitation information from the codebooks 104 and 105.

Target excitation calculator 102 calculates the target excitation which searchers 106 and 107 attempt to approximate. This target excitation is calculated by convolving a whitening filter based on the LPC coefficients calculated by analyzer 101 with the incoming speech minus the effects of the excitation and LPC filter for the previous frame. The latter effects for the previous frames are calculated by filters 110 and 111. The reason that the excitation and LPC filter for the previous frame must be considered is that these factors produce a signal component in the present frame which is often referred to as the ringing of the LPC filter. As will be described later, filters 110 and 111 are responsive to the LPC coefficients and calculated excitation from the previous frame to determine this ringing signal and to transmit it via path 144 to subtracter 112. Subtracter 112 is responsive to the latter signal and the present speech to calculate a remainder signal representing the present speech minus the ringing signal. Calculator 102 is responsive to the remainder signal to calculate the target excitation information and to transmit the latter information via path 123 to searcher 106 and 107.

The latter searchers work sequentially to determine the calculated excitation also referred to as synthesis excitation which is transmitted in the form of codebook indices and scaling factors via encoder 109 and path 145 to the synthesizer portion of FIG. 1. Each searcher calculates a portion of the calculated excitation. First, adaptive searcher 106 calculates excitation information and transmits this via path 127 to stochastic searcher 107. Searcher 107 is responsive to the target excitation received via path 123 and the excitation information from adaptive searcher 106 to calculate the remaining portion of the calculated excitation that best approximates the target excitation calculated by calculator 102. Searcher 107 determines the remaining excitation to be calculated by subtracting the excitation determined by searcher 106 from the target excitation. The calculated or synthetic excitation determined by searchers 106 and 107 is transmitted via paths 127 and 126, respectively, to adder 108. Adder 108 adds the two excitation components together to arrive at the synthetic excitation for the present frame. The synthetic excitation is used by the synthesizer to produce the synthesized speech.

The output of adder 108 is also transmitted via path 128 to LPC filter 110 and adaptive codebook 104. The excitation information transmitted via path 128 is utilized to update adaptive codebook 104. The codebook indices and scaling factors are transmitted from searchers 106 and 107 to encoder 109 via paths 125 and 124, respectively.

Searcher 106 functions by accessing sets of excitation information stored in adaptive codebook 104 and utilizing each set of information to minimize an error criterion between the target excitation received via path 123 and the accessed set of excitation from codebook 104. A scaling factor is also calculated for each accessed set of information since the information stored in adaptive codebook 104 does not allow for the changes in dynamic range of human speech.

The error criterion used is the square of the difference between the original and synthetic speech. The synthetic speech is that which will be reproduced in the synthesizer portion of FIG. 1 on the output of LPC filter 117. The synthetic speech is calculated in terms of the synthetic excitation information obtained from codebook 104 and the ringing signal; and the speech signal is calculated from the target excitation and the ringing signal. The excitation information for synthetic speech is utilized by performing a convolution of the LPC filter as determined by analyzer 102 utilizing the weighting information from calculator 103 expressed as a matrix. The error criterion is evaluated for each set of information obtained from codebook 104, and the set of excitation information giving the lowest error value is the set of information utilized for the present frame.

After searcher 106 has determined the set of excitation information to be utilized along with the scaling factor, the index into the codebook and the scaling factor are transmitted to encoder 109 via path 125, and the excitation information is also transmitted via path 127 to stochastic searcher 107. Stochastic searcher 107 subtracts the excitation information from adaptive searcher 106 from the target excitation received via path 123. Stochastic searcher 107 then performs operations similar to those performed by adaptive searcher 106.

The excitation information in adaptive codebook 104 is excitation information from previous frames. For each frame, the excitation information consists of the same number of samples as the sampled original speech. Advantageously, the excitation information may consist of 55 samples for a 4.8 Kbps transmission rate. The codebook is organized as a push down list so that the new set of samples are simply pushed into the codebook replacing the earliest samples presently in the codebook. When utilizing sets of excitation information out of codebook 104, searcher 106 does not treat these sets of information as disjoint sets of samples but rather treats the samples in the codebook as a linear array of excitation samples. For example, searcher 106 will form the first candidate set of information by utilizing sample 1 through sample 55 from codebook 104, and the second set of candidate information by using sample 2 through sample 56 from the codebook. This type of searching a codebook is often referred to as an overlapping codebook.

As this linear searching technique approaches the end of the samples in the codebook there is no longer a full set of information to be utilized. A set of information is also referred to as an excitation vector. At that point, the searcher performs a virtual search. A virtual search involves repeating accessed information from the table into a later portion of the set for which there are no samples in the table. This virtual search technique allows the adaptive searcher 106 to more quickly react to speech transitions such as from an unvoiced region of speech to a voiced region of speech. The reason is that in unvoiced speech regions the excitation is similar to white noise whereas in the voiced regions there is a fundamental frequency. Once a portion of the fundamental frequency has been identified from the codebooks, it is repeated.

Figure 2:
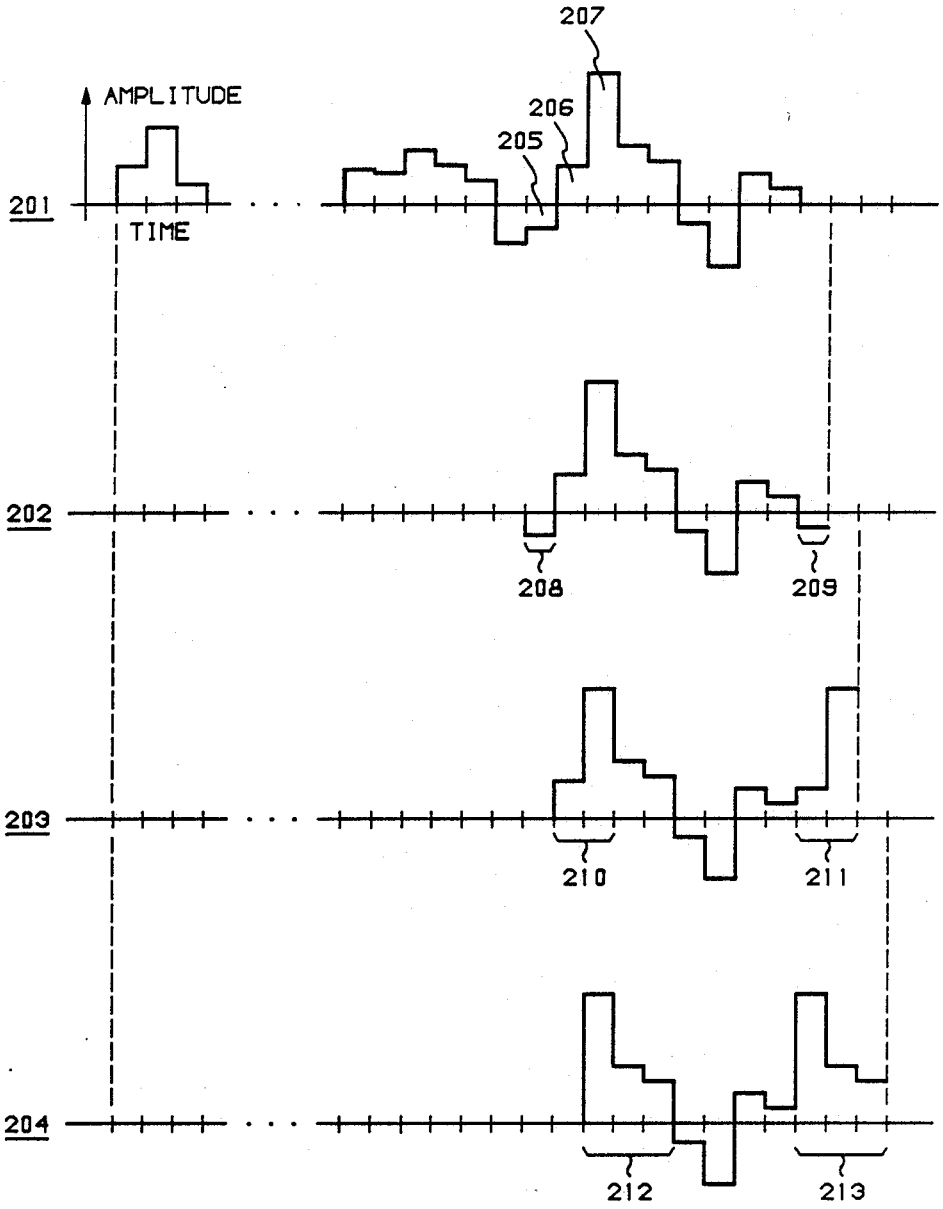
FIG. 2 illustrates, in graphic form, the formation of excitation vectors from codebook 104 using the virtual search technique which is the subject of this invention.

FIG. 2 illustrates a portion of excitation samples such as would be stored in codebook 104 but where it is assumed for the sake of illustration thatthere are only 10 samples per excitation set. Line 201 illustrates that the contents of the codebook and lines 202, 203 and 204 illustrate excitation sets which have been formed utilizing the virtual search technique. The excitation set illustrated in line 202 is formed by searching the codebook starting at sample 205 on line 201. Starting at sample 205, there are only 9 samples in the table, hence, sample 208 is repeated as sample 209 to form the tenth sample of the excitation set illustrated in line 202. Sample 208 of line 202 corresponds to sample 205 of line 201. Line 203 illustrates the excitation set following that illustrated in line 202 which is formed by starting at sample 206 on line 201. Starting at sample 206 there are only 8 samples in the code book, hence, the first 2 samples of line 203 which are grouped as samples 210 are repeated at the end of the excitation set illustrated in line 203 as samples 211. It can be observed by one skilled in the art that if the significant peak illustrated in line 203 was a pitch peak then this pitch has been repeated in samples 210 and 211. Line 204 illustrates the third excitation set formed starting at sample 207 in the codebook. As can be seen, the 3 samples indicated as 212 are repeated at the end of the excitation set illustrated on line 204 as samples 213. It is important to realize that the initial pitch peak which is labeled as 207 in line 201 is a cumulation of the searches performed by searchers 106 and 107 from the previous frame since the contents of codebook 104 are updated at the end of each frame. The statistical searcher 107 would normally arrive first at a pitch peak such as 207 upon entering a voiced region from an unvoiced region.

Stochastic searcher 107 functions in a similar manner as adaptive searcher 106 with the exception that it uses as a target excitation the difference between the target excitation from target excitation calculator 102 and excitation representing the best match found by searcher 106. In addition, search 107 does not perform a virtual search.

A detailed explanation is now given of the analyzer portion of FIG. 1. This explanation is based on matrix and vector mathematics. Target excitation calculator 102 calculates a target excitation vector, t, in the following manner. A speech vector s can be expressed as $$s=Ht+z.$$

The H matrix is the matrix representation of the all-pole LPC synthesis filter as defined by the LPC coefficients received from LPC analyzer 101 via path 121. The structure of the filter represented by H is described in greater detail later in this section and is part of the subject of this invention. The vector z represents the ringing of the all-pole filter from the excitation received during the previous frame. As was described earlier, vector z is derived from LPC filter 110 and zero-input response filter 111. Calculator 102 and subtracter 112 obtain the vector t representing the target excitation by subtracting vector z from vector s and processing the resulting signal vector through the all-zero LPC analysis filter also derived from the LPC coefficients generated by LPC analyzer 101 and transmitted via path 121. The target excitation vector t is obtained by performing a convolution operation of the all-zero LPC analysis filter, also referred to as a whitening filter, and the difference signal found by subtracting the ringing from the original speech. This convolution is performed using well-known signal processing techniques.

Adaptive searcher 106 searches adaptive codebook 104 to find a candidate excitation vector r that best matches the target excitation vector t. Vector r is also referred to as a set of excitation information. The error criterion used to determine the best match is the square of the difference between the original speech and the synthetic speech. The original speech is given by vector s and the synthetic speech is given by the vector y which is calculated by the following equation:

$$y=HL_ir_i+z,$$

where $L_i$ is a scaling factor.

The error criterion can be written in the following form:

$$e=(Ht+z-HL_ir_i-z)^T(Ht+z-HL_ir_i-z). \quad (1)$$

In the error criterion, the H matrix is modified to emphasis those sections of the spectrum which are perceptually important. This is accomplished through well known pole-bandwidth widing technique. Equation 1 can be rewritten in the following form:

$$e=(t-L_i r_i)^T H^T H(t-L_i r_i). \tag{2}$$

Equation 2 can be further reduced as illustrated in the following:

$$e=t^T H^T Ht+L_i r_i^T H^T HL_i r_i-2L_i r_i^T H^T Ht. \tag{3}$$

The first term of equation 3 is a constant with respect to any given frame and is dropped from the calculation of the error in determining which $r_i$ vector is to be utilized from codebook 104. For each of the $r_i$ excitation vectors in codebook 104, equation 3 must be solved and the error criterion, e, must be determined so as to chose the $r_i$ vector which has the lowest value of e. Before equation 3 can be solved, the scaling factor, $L^i$ must be determined. This is performed in a straight forward manner by taking the partial derivative with respect to $L_i$ and setting it equal to zero, which yields the following equation:

$$L_i = \frac{r_i^T H^T Ht}{r_i^T H^T Hr_i}. \tag{4}$$

The numerator of equation 4 is normally referred to as the cross-correlation term and the denominator is referred to as the energy term. The energy term requires more computation than the cross-correlation term. The reason is that in the cross-correlation term the product of the last three elements needs only to be calculated once per frame yielding a vector; and then for each new candidate vector, $r_i$, it is simply necessary to take the dot product between the candidate vector transposed and the constant vector resulting from the computation of the last three elements of the cross-correlation term.

The energy term involves first calculating $Hr_i$ then taking the transpose of this and then taking the inner product between the transpose of $Hr_i$ and $Hr_i$. This results in a large number of matrix and vector operations requiring a large number of calculations. The present invention is directed towards reducing the number of calculations and enhancing the resulting synthetic speech.

In part, the present invention realizes this goal by utilizing a finite impulse response LPC filter rather than an infinite impulse response LPC filter as utilized in the prior art. The utilization of a finite impulse response filter having a constant reponse length results in the H matrix having a different symmetry than in the prior art. The H matrix represents the operation of the finite impulse response filter in terms of matrix notation. Since the filter is a finite impulse response filter, the convolution of this filter and the excitation information represented by each candidate vector, $r_i$, results in each sample of the vector $r_i$ generating a finite number of response samples which are designated as R number of samples. When the matrix vector operation of calculating $Hr_i$ is performed which is a convolution operation, all of the R response points resulting from each sample in the candidate vector, $r_i$, are summed together to form a frame of synthetic speech.

The H matrix representing the finite impulse response filter is an N+R by N matrix, where N is the frame length in samples, and R is the length of the truncated impulse response in number of samples. Using this form of the H matrix, the response vector Hr has a length of N+R. This form of H matrix is illustrated in the following equation 5:

$$H=\begin{bmatrix} h_0 & 0 & \cdot & \cdot & 0 \\ h_1 & h_0 & \cdot & \cdot & \cdot \\ \cdot & \cdot & \cdot & \cdot & \cdot \\ h_R & h_{R-1} & \cdot & \cdot & \cdot \\ 0 & h_R & \cdot & \cdot & h_0 \\ \cdot & 0 & \cdot & \cdot & h_1 \\ \cdot & \cdot & \cdot & \cdot & \cdot \\ \cdot & \cdot & \cdot & h_R & h_{R-1} \\ 0 & 0 & \cdot & 0 & h_R \end{bmatrix}. \tag{5}$$

Consider the product of the transpose of the H matrix and the H matrix itself as in equation 6:

$$A=H^T H. \tag{6}$$

Equation 6 results in matrix A which is N by N square, symmetric, and Toeplitz as illustrated in the following equation 7.

$$A=\begin{bmatrix} A_0 & A_1 & A_2 & A_3 & A_4 \\ A_1 & A_0 & A_1 & A_2 & A_3 \\ A_2 & A_1 & A_0 & A_1 & A_2 \\ A_3 & A_2 & A_1 & A_0 & A_1 \\ A_4 & A_3 & A_2 & A_1 & A_0 \end{bmatrix}. \tag{7}$$

Equation 7 illustrates the A matrix which results from $H^T H$ operation when N is five. One skilled in the art would observe from equation 5 that depending on the value of R that certain of the elements in matrix A would be 0. For example, if R=2 then elements $A_2$, $A_3$ and $A_4$ would be 0.

FIG. 3 illustrates what the energy term would be for the first candidate vector $r_1$ assuming that this vector contains 5 samples which means that N equals 5. The samples $X_0$ through $X_4$ are the first 5 samples stored in adaptive codebook 104. The calculation of the energy term of equation 4 for the second candidate vector $r_2$ is illustrated in FIG. 4. The latter figure illustrates that only the candidate vector has changed and that it has only changed by the deletion of the $X_0$ sample and the addition of the $X_5$ sample.

The calculation of the energy term illustrated in FIG. 3 results in a scalar value. This scalar value for $r_1$ differs from that for candidate vector $r_2$ as illustrated in FIG. 4 only by the addition of the $X_5$ sample and the deletion of the $X_0$ sample. Because of the symmetry and Toeplitz nature introduced into the A matrix due to the utilization of a finite impulse response filter, the scalar value for FIG. 4 can be easily calculated in the following manner. First, the contribution due to the $X_0$ sample is eliminated by realizing that its contribution is easily determinable as illustrated in FIG. 5. This contribution can be removed since it is simply based on the multiplication and summation operations involving term 501 with terms 502 and the operations involving terms 504 with term 503. Similarly, FIG. 6 illustrates that the addition of term $X_5$ can be added into the scalar value by realizing that its contribution is due to the operations involving term 601 with terms 602 and the operations involving terms 604 with the terms 603. By subtracting the contribution of the terms indicated in FIG. 5 and adding the effect of the terms illustrated in FIG. 6, the energy term for FIG. 4 can be recursively calculated from the energy term of FIG 3. It would be obvious to one skilled in the art that this method of recursive calculation is independent of the size of the vector $r_i$ or the A matrix. These recursive calculations allow the candidate vectors contained within adaptive codebook 104 or codebook 105 to be compared with each other but only requiring the additional operations illustrated by FIGS. 5 and 6 as each new excitation vector is taken from the codebook.

In general terms, these recursive calculations can be mathematically expressed in the following manner. First, a set of masking matrices is defined as $I_k$ where the last one appears in the kth row.

$$I_k = \begin{bmatrix} 1 & 0 & . & . & . & 0 \\ 0 & 1 & . & . & . & . \\ . & . & . & . & . & . \\ . & . & . & 1 & 0 & . \\ . & . & . & 0 & 0 & . \\ . & . & . & . & . & . \\ 0 & . & . & . & . & 0 \end{bmatrix}. \tag{8}$$

In addition, the unity matrix is defined as I as follows:

$$I = \begin{bmatrix} 1 & 0 & . & . & . & . \\ 0 & 1 & 0 & . & . & . \\ . & 0 & 1 & 0 & . & . \\ . & . & 0 & 1 & 0 & . \\ . & . & . & 0 & 1 & 0 \\ 0 & . & . & . & 0 & 1 \end{bmatrix}. \tag{9}$$

Further, a shifting matrix is defined as follows:

$$S = \begin{bmatrix} 0 & 1 & 0 & . & . & 0 \\ 0 & 0 & 1 & . & . & . \\ . & . & . & . & . & . \\ . & . & . & . & 0 & 1 \\ 0 & . & . & . & 0 & 0 \end{bmatrix}. \tag{10}$$

For Toeplitz matrices, the following well known theorem holds:

$$S^T A S = (I - I_1) A (I - I_1). \tag{11}$$

Since A or $H^T H$ is Toeplitz, the recursive calculation for the energy term can be expressed using the following nomenclature. First, define the energy term associated with the $r_{j+1}$ vector as $E_{j+1}$ as follows:

$$E_{j+1} = r_{j+1}{}^T H^T H r_{j+1}. \tag{12}$$

In addition, vector $r_{j+1}$ can be expressed as a shifted version of $r_j$ combined with a vector containing the new sample of $r_{j+1}$ as follows:

$$r_{j+1} = S r_j + (I - I_{N-1}) r_{j+1}. \tag{13}$$

Utilizing the theorem of equation 11 to eliminate the shift matrix S allows equation 12 to be rewritten in the following form:

$$E_{j+1} = E_j + 2\,[r_{j+1}^T (I - I_{N-1}) H^T H S r_j - r_j^T (I - I_1) H^T H I_1 r_j] - r_j^T I_1 H^T H I_1 r_j + r_{j+1}^T (I - I_{N-1}) H^T H (I - I_{N-1}) r_{j+1}. \tag{14}$$

It can be observed from equation 14, that since the I and S matrices contain predominantly zeros with a certain number of ones that the number of calculations necessary to evaluate equation 14 is greatly reduced from that necessary to evaluate equation 3. A detailed analysis by one skilled in the art would indicate that the calculation of equation 14 requires only 2Q+4 floating point operations, where Q is the smaller of the number R or the number N. This is a large reduction in the number of calculations from that required for equation 3. This reduction in calculation is accomplished by utilizing a finite impulse response filter rather than an infinite impulse response filter and by the Toeplitz nature of the $H^T H$ matrix.

Equation 14 properly computes the energy term during the normal search of codebook 104. However, once the virtual searching commences, equation 14 no longer would correctly calculate the energy term since the virtual samples as illustrated by samples 213 on line 204 of FIG. 2 are changing at twice the rate. In addition, the samples of the normal search illustrated by samples 214 of FIG. 2 are also changing in the middle of the excitation vector. This situation is resolved in a recursive manner by allowing the actual samples in the codebook, such as samples 214, to be designated by the vector $w_i$ and those of the virtual section, such as samples 213 of FIG. 2, to be denoted by the vector $v_i$. In addition, the virtual samples are restricted to less than half of the total excitation vector. The energy term can be rewritten from equation 14 utilizing these conditions as follows:

$$E_i = w_i{}^T H^T H w_i + 2 v_i{}^T H^T H w_i + v_i{}^T H^T H v_i. \tag{15}$$

The first and third terms of equation 15 can be computationally reduced in the following manner. The recursion for the first term of equation 15 can be written as:

$$w_{j+1}{}^T H^T H w_{j+1} = w_j{}^T H^T H w_j - 2 w_j{}^T (I - I_1) H^T H I_1 w_j. - w_j{}^T I_1 H^T H I_1 w_j. \tag{16}$$

and the relationship between $v_j$ and $v_{j+1}$ can be written as follows:

$$v_{j+1} = S^2 (I - I_{p+1}) v_j + (I - I_{N-2}) v_{j+1}. \tag{17}$$

This allows the third term of equation 15 to be reduced by using the following:

$$H^T H v_{j+1} = S^2 H^T H v_j + H^T H S^2 (I_p - I_{p+1}) v_j + (I - I_{N-2}) H^T H S^2 (I - I_{p+1}) v_j + H^T. H (I - I_{N-2}) v_{j+1}. \tag{18}$$

The variable p is the number of samples that actually exists in the codebook 104 that are presently used in the existing excitation vector. An example of the number of samples is that given by samples 214 in FIG. 2. The second term of equation 15 can also be reduced by equation 18 since $v_i{}^T H^T H$ is simply the transpose of $H^T H v_i$ in matrix arithmetic. One skilled in the art can immediately observe that the rate at which searching is done through the actual codebook samples and the virtual samples is different. In the above illustrated example, the virtual samples are searched at twice the rate of actual samples.

Figure 7:
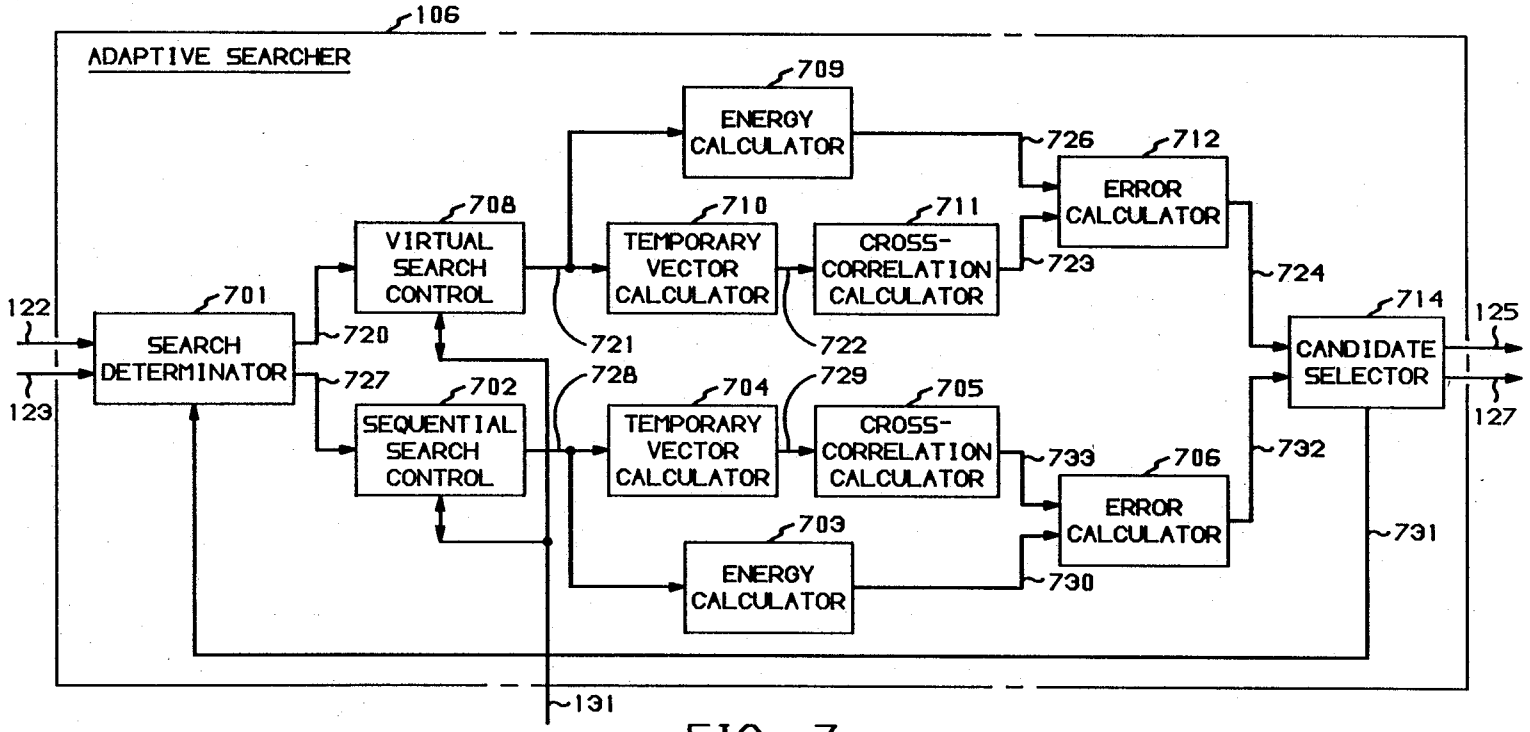
FIG. 7 illustrates, in greater detail, adaptive searcher 106 of FIG. 1.

FIG. 7 illustrates adaptive searcher 106 of FIG. 1 in greater detail. As previously described, adaptive searcher 106 performs two types of search operations: virtual and sequential. During the sequential search operation, searcher 106 accesses a complete candidate excitation vector from adaptive codebook 104; whereas, during a virtual search, adaptive searcher 106 accesses a partial candidate excitation vector from codebook 104 and repeats the first portion of the candidate vector accessed from codebook 104 into the latter portion of the candidate excitation vector as illustrated in FIG. 2. The virtual search operations are performed by blocks 708 through 712, and the sequential search operations are performed by blocks 702 through 706. Search determinator 701 determines whether a virtual or a sequential search is to be performed. Candidate selector 714 determines whether the codebook has been competely searched; and if the codebook has not been completely searched, selector 714 returns control back to search determinator 701.

Search determinator 701 is responsive to the spectral weighting matrix received via path 122 and the target excitation vector received path 123 to control the complete search codebook 104. The first group of candidate vectors are filled entirely from the codebook 104 and the necessary calculations are performed by blocks 702 through 706, and the second group of candidate excitation vectors are handled by blocks 708 through 712 with portions of vectors beings repeated.

If the first group of candidate excitation vectors is being accessed from codebook 104, search determinator communicates the target excitation vector, spectral weighting matrix, and index of the candidate excitation vector to be accessed to sequential search control 702 via path 727. The latter control is responsive to the candidate vector index to access codebook 104. The sequential search control 702 then transfers the target excitation vector, the spectral weighting matrix, index, and the candidate excitation vector to blocks 703 and 704 via path 728.

Block 704 is responsive to the first candidate excitation vector received via path 728 to calculate a temporary vector equal to the $H^THt$ term of equation 3 and transfers this temporary vector and information received via path 728 to cross-correlation calculator 705 via path 729. After the first candidate vector, block 704 just communicates information received on path 728 to path 729. Calculator 705 calculates the cross-correlation term of equation 3.

Energy calculator 703 is responsive to the information on path 728 to calculate the energy term of equation 3 by performing the operations indicated by equation 14. Calculator 703 transfers this value to error calculator 706 via path 733.

Error calculator 706 is responsive to the information received via paths 730 and 733 to calculate the error value by adding the energy value and the cross-correlation value and to transfer that error value along with the candidate number, scaling factor, and candidate value to candidate selector 714 via path 730.

Candidate selector 714 is responsive to the information received via path 732 to retain the information of the candidate whose error value is the lowest and to return control to search determinator 701 via path 731 when actuated via path 732.

When search determinator 701 determines that the second group of candidate vectors is to be accessed from codebook 104, it transfers the target excitation vector, spectral weighting matrix, and candidate excitation vector index to virtual search control 708 via path 720. The latter search control accesses codebook 104 and transfers the accessed code excitation vector and information received via path 720 to blocks 709 and 710 via path 721. Blocks 710, 711 and 712, via paths 722 and 723, perform the same type of operations as performed by blocks 704, 705 and 706. Block 709 performs the operation of evaluating the energy term of equation 3 as does block 703; however, block 709 utilizes equation 15 rather than equation 14 as utilized by energy calculator 703.

For each candidate vector index, scaling factor, candidate vector, and error value received via path 724, candidate selector 714 retains the candidate vector, scaling factor, and the index of the vector having the lowest error value. After all of the candidate vectors have been processed, candidate selector 714 then transfers the index and scaling factor of the selected candidate vector which has the lowest error value to encoder 109 via path 125 and the selected excitation vector via path 127 to adder 108 and stochastic searcher 107 via path 127.

Figure 8:
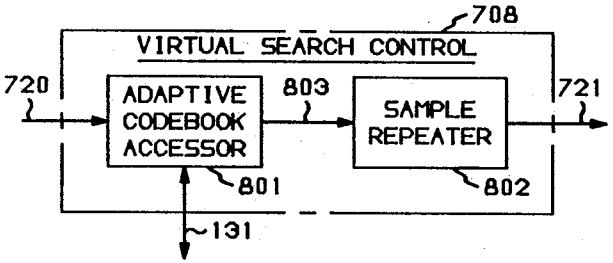
FIG. 8 illustrates, in greater detail, virtual search control 708 of FIG. 7.

FIG. 8 illustrates, in greater detail, virtual search control 708. Adaptive codebook accessor 801 is responsive to the candidate index received via path 720 to access codebook 104 and to transfer the accessed candidate excitation vector and information received via path 720 to sample repeater 802 via path 803. Sample repeater 802 is responsive to the candidate vector to repeat the first portion of the candidate vector into the last portion of the candidate vector in order to obtain a complete candidate excitation vector which is then transferred via path 721 to blocks 709 and 710 of FIG. 7.

Figure 9:
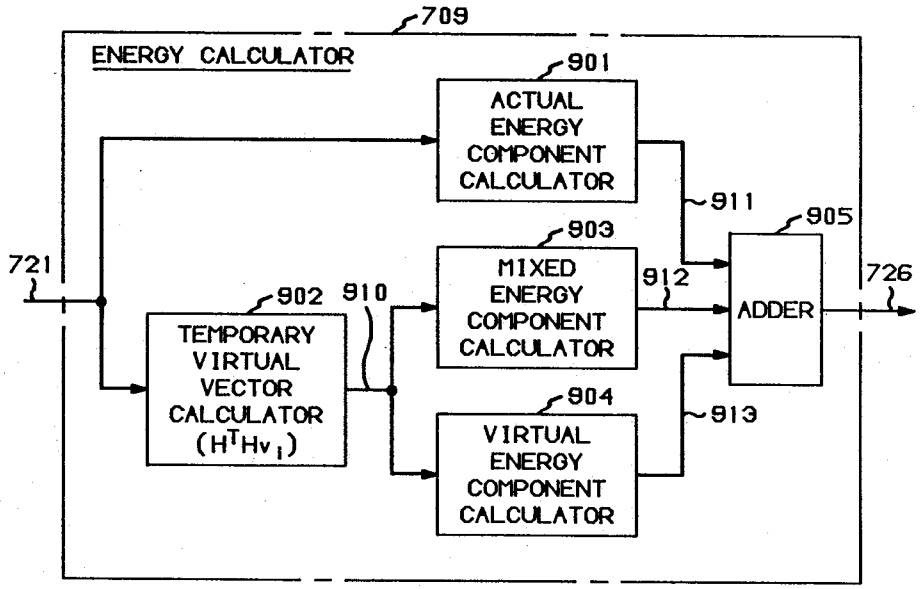
FIG. 9 illustrates, in greater detail, energy calculator 709 of FIG. 7.

FIG. 9 illustrates, in greater detail, the operation of energy calculator 709 in performing the operations indicated by equation 18. Actual energy component calculator 901 performs the operations required by the first term of equation 18 and transfers the results to adder 905 via path 911. Temporary virtual vector calculator 902 calculates the term $H^THv_i$ in accordance with equation 18 and transfers the results along with the information received via path 721 to calculators 903 and 904 via path 910. In response to the information on path 910, mixed energy component calculator 903 performs the operations required by the second term of equation 15 and transfers the results to adder 905 via path 913. In response to the information on path 910, virtual energy component calculator 904 performs the operations required by the third term of equation 15. Adder 905 is responsive to information on paths 911, 912, and 913 to calculate the energy value and to communicate that value on path 726.

Stochastic searcher 107 comprises blocks similar to blocks 701 through 706 and 714 as illustrated in FIG. 7. However, the equivalent search determinator 701 would form a second target excitation vector by subtracting the selected candidate excitation vector received via path 127 from the target excitation received via path 123. In addition, the determinator would always transfer control to the equivalent control 702.

Microfiche Appendix A comprises a C language source program that implements this invention. The program of Microfiche Appendix A is intended for execution of a Digital Equipment Corporation's VAX 11/780-5 computer system with appropriate peripheral equipment or a similar system.

It is to be understood that the afore-described embodiments are merely illustrative of the principles of the invention and that other arrangements may be devised by those skilled in the art without departing from the spirit and scope of the invention.

What is claimed is:

1. A method of encoding speech for communication to a decoder for reproduction and said speech comprises frames of speech each having a plurality of samples, comprising the steps of:

storing a plurality of candidate sets of excitation information each having samples in a table, a group of said sets of excitation information having fewer samples than each of said frames of speech and remaining sets of said sets of excitation information having the same number of samples as each of said frames of speech;

searching said plurality of candidate sets of excitation information with a present one of said frames to determine the candidate set of excitation information that best matches said present frame by repeating upon searching each of said group of said candidate sets a portion of each of said group of said candidate sets of excitation information so that each of said group of said candidate sets of excitation information has the same number of samples as said present frame; and communicating information to identify the location of the determined candidate set of excitation information in said table for reproduction of said speech for said present frame by said decoder.

2. The method of claim 1 wherein said step of searching comprises the steps of:

storing excitation information in said table as a linear array of samples;

shifting a window through said array equal to the number of samples in said present frame to form each candidate set of excitation information; and repeating a portion of each of said group of said candidate sets of excitation in information to complete each of said group of said candidate sets of excitation information.

3. The method of claim 2 wherein said remaining sets of said candidate sets of excitation information are filled entirely with samples from said array.

4. The method of claim 3 wherein said searching step further comprises the steps of:

forming a target set of excitation information in response to a present one of said frames of speech;

calculating a temporary set of excitation information from said target set of excitation information and the determined candidate set of excitation information;

searching a plurality of other candidate sets of excitation information stored in another table with said temporary set of excitation information to determine the other candidate set of excitation information that best matches said temporary set of excitation information from said other table;

determining another location of the other determined candidate set of excitation information in said other table; and said step of communicating further communicates said other location for reproduction of said speech for said present frame by said decoder.

5. The method of claim 4 where said searching step further comprises the steps of determining a set of filter coefficients in response to said present one of said frames of speech;

calculating information representing a finite impulse response filter from said set of filter coefficients;

recursively calculating an error value for each of said plurality of candidate sets of excitation information stored in said table in response to the finite impulse response filter information in each of said candidate sets of excitation information and said target set of excitation information; and selecting said determined candidate set of excitation information whose calculated error value is the smallest.

6. The method of claim 5 wherein said step of communicating further communicates said filter coefficients for reproduction of said speech for said present frame by said decoder.

7. The method of claim 6 further comprises the step of updating said table by replacing one of said candidates sets of excitation information with said determined one of said candidate sets of excitation information from said table.

8. A method for encoding speech for communication to a decoder for reproduction and said speech comprises frames with each frame represented by a speech vector having a plurality of samples, comprising the steps of:

calculating a target excitation vector in response to a present speech vector;

storing a plurality of candidate excitation vectors having samples in an overlapping table, a group of said candidate excitation vectors having fewer samples than said target excitation vector and a remainder of said candidate excitation vectors having the same number of samples as said target excitation vector;

calculating an error value associated with each of said plurality of candidate excitation vectors, said error value being a function of its associated candidate excitation vector and said target excitation vector and calculating an error value by repeating for each of said group of candidate excitation vectors a portion of each of said group of said candidate speech vectors so that each of said group of candidate excitation vectors has the same number of samples as said target excitation vector thereby compensating for speech transitions such as between unvoiced and voiced regions of said speech;

selecting the candidate excitation vector whose calculated error value is the smallest; and communicating information defining the location of the selected candidate excitation vector in said table.

9. The method of claim 8 wherein said step of calculating comprises the steps of:

storing an array of samples in said table;

shifting a window through said array equal to the number of samples in said present speech vector to form each of said candidate excitation vectors; and repeating a portion of each of said group of said candidate excitation to complete each of said group of candidate excitation vectors.

10. The method of claim 9 wherein said remainder of candidate excitation vectors are filled entirely with samples accessed sequentially from said array.

11. The method of claim 10 wherein said calculating step further comprises the steps of:

calculating a temporary excitation vector from said target excitation vector and the selected excitation vector;

calculating a set of filter coefficients in response to a present one of said speech vectors;

calculating a response matrix to model a finite impulse response filter based on said filter coefficients for said present speech vector;

calculating a spectral weighting matrix of a Toeplitz form by matrix operations on said response matrix;

calculating a cross-correlation value in response to said temporary excitation vector and said spectral weighting matrix and each of a plurality of other candidate speech vectors stored in another overlapping table;

recursively calculating an energy value for each of said other candidate excitation vectors in response to said temporary excitation vector and said spectral weighting matrix and each of said other candidate excitation vectors;

calculating an error value for each of said other candidate excitation vectors in response to each of said cross-correlation and energy values for each of said other candidate excitation vectors;

selecting the other candidate excitation vector whose calculated error value is the smallest;

said communicating step further communicates the location of the selected other candidate excitation vector in said other table for reproduction of said speech for said present speech vector.

12. Apparatus for encoding speech to be communicated to a decoder for reproduction and said speech comprises frames each having a plurality of samples, comprising;

means for storing a plurality of candidate sets of excitation information each having samples in a table, a group of said sets of excitation information having fewer samples than each of said frames of speech and remaining sets of said sets of excitation information having the same number of samples as each of said frames of speech;

means for searching through said plurality of candidate sets of excitation information with a present one of said frames to determine the candidate set of excitation information that best matches said present frame by repeating upon searching each of said group of said candidate sets of excitation information a portion of each of said group of said candidate sets of excitation information so that each of said group of said candidate sets of excitation information has the same number of samples as said present frame thereby compensating the amount of matching during speech transitions such as between unvoiced and voiced regions of said speech; and means for communicating information to identify the location of the determined candidate set of excitation information in said table for reproduction of said speech for said present frame by said decoder.

13. The apparatus of claim 12 wherein said searching means comprises:

means for storing excitation information in said table as a linear array of samples;

means for shifting a window through said array equal to the number of samples in said present frame to form each candidate set of excitation information; and means for repeating a portion of each of said group of said candidate sets of excitation information to complete each of said group of said candidate sets of excitation information.

14. The apparatus of claim 13 wherein said remainder candidate sets of excitation information are filled entirely with samples said array.

15. The apparatus of claim 14 wherein said searching means further comprises:

means for forming a target set of excitation information in response to a present one of said frames of speech;

means for calculating a temporary set of excitation information from said target set of excitation information and the determined candidate set of excitation information;

means for searching a plurality of other candidate sets of excitation information stored in another table with said temporary set of excitaton information to determine the other candidate set of excitation information that best matches said temporary set of excitation information from said other table;

means for determining a location of the other determined candidate set of excitation information in said other table; and said step of communicating further communicates said other location for reproduction of said speech for said present frame by said decoder.

16. The apparatus of claim 15 wherein said searching step further comprises means for determining a set of filter coefficients in response to said present one of said frames of speech;

means for calculating information representing a finite impulse response filter from said set of filter coefficients;

means for recursively calculating an error value for each of said plurality of candidate sets of excitation information stored in said table in response to the finite impulse response filter information in each of said candidate sets of excitation information and said target set of excitation information; and means for selecting said determined candidate set of excitation information whose calculated error value is the smallest.

17. The apparatus of claim 16 wherein communicating means further communicates said filter coefficients for reproduction of said speech for said present frame by said decoder.

18. The apparatus of claim 17 further comprises means for updating said table by replacing one of said candidate sets of excitation information with said determined one of said candidate sets of excitation information from said table.

* * * * *